US012345512B2

(12) United States Patent
Moser

(10) Patent No.: US 12,345,512 B2
(45) Date of Patent: Jul. 1, 2025

(54) KNOCKDOWN-FIELD-TARGET RESETTING SYSTEM

(71) Applicant: Jacob Paul Moser, Sedona, AZ (US)

(72) Inventor: Jacob Paul Moser, Sedona, AZ (US)

( * ) Notice: Subject to any disclaimer, the term of this patent is extended or adjusted under 35 U.S.C. 154(b) by 0 days.

(21) Appl. No.: 18/342,725

(22) Filed: Jun. 27, 2023

(65) Prior Publication Data

US 2023/0417518 A1 Dec. 28, 2023

Related U.S. Application Data

(60) Provisional application No. 63/356,012, filed on Jun. 27, 2022.

(51) Int. Cl.
*F41J 7/04* (2006.01)

(52) U.S. Cl.
CPC ..... *F41J 7/04* (2013.01)

(58) Field of Classification Search
CPC ..... F41J 7/04
USPC ..... 273/392
See application file for complete search history.

(56) References Cited

U.S. PATENT DOCUMENTS 3,064,976 A * 11/1962 Kuhn ..... A63B 63/00 273/369
3,434,717 A * 3/1969 Schwartz ..... F41J 7/04 273/DIG. 8
4,222,564 A * 9/1980 Allen ..... F41J 7/00 273/369
4,288,080 A * 9/1981 Laporte ..... F41J 7/06 273/406
4,426,085 A * 1/1984 Dixon ..... F41J 7/04 273/392
4,588,194 A 5/1986 Steidle et al.
4,732,394 A * 3/1988 Stein ..... F41J 7/04 273/391
5,232,227 A 8/1993 Bateman
(Continued)

FOREIGN PATENT DOCUMENTS

KR 20160055567 A 5/2016

OTHER PUBLICATIONS

"Shooting Target Reset system," Arduino.cc, Project Guidance forum, posted Apr. 2014, https://forum.arduino.cc/t/shooting-target-reset-system/226203 (Year: 2014).*
(Continued)

*Primary Examiner* — Melba Bumgarner
*Assistant Examiner* — Amir A Klayman

(57) ABSTRACT

A knockdown-field-target resetting system is a remote-controlled system to return a knockdown-field-target back to its upright starting position after being shot down by a gun projectile. The system includes a device enclosure, a micro-controller, a wireless communication module, a portable power source, a lift arm, an arm actuator, and a remote control. The microcontroller, the wireless communication module, and the portable power source are housed within the device enclosure. After the knockdown field target is shot down, the remote control sends a wireless instruction, which is received by the microcontroller through the wireless communication module. The microcontroller then instructs the arm actuator to move the knockdown field target back to its upright starting position by pushing the knockdown field target with the lift arm.

17 Claims, 13 Drawing Sheets

(56) References Cited

U.S. PATENT DOCUMENTS

| | | | | |
|---|---|---|---|---|
| 5,340,116 | A | 8/1994 | Reinart | |
| 6,736,400 | B1 | 5/2004 | Cesternino | |
| 7,694,973 | B1 * | 4/2010 | Hofmeister | F41J 7/06 273/391 |
| 7,950,667 | B2 * | 5/2011 | Shum | F41J 7/06 273/406 |
| 8,608,169 | B2 * | 12/2013 | Saunders | F41J 7/04 273/392 |
| 9,097,498 | B2 * | 8/2015 | Burtan | F41J 7/06 |
| 9,228,809 | B1 * | 1/2016 | Relyea | F41J 9/02 |
| 10,088,280 | B2 * | 10/2018 | McFadyen | F41J 7/06 |
| 10,107,600 | B2 * | 10/2018 | Atluri | F41J 7/06 |
| 10,139,203 | B1 | 11/2018 | Teal | |
| 11,391,548 | B1 * | 7/2022 | Woitas | F41J 7/04 |
| 11,566,875 | B1 * | 1/2023 | Spikes | F41J 7/04 |
| 2002/0030323 | A1 | 3/2002 | Slifko | |
| 2008/0023915 | A1 | 1/2008 | Morrow et al. | |
| 2016/0195369 | A1 * | 7/2016 | Perry | F41J 7/04 273/386 |
| 2019/0041172 | A1 * | 2/2019 | Kerley | F41J 5/06 |
| 2023/0235996 | A1 * | 7/2023 | Rempel | F41J 7/04 273/369 |

OTHER PUBLICATIONS

Sniper's Hide Forum, "DIY Wind Indicators," May 22, 2011, https://www.snipershide.com/shooting/threads/diy-wind-indicators.77702/ (Year: 2011).*

MAMBATARGET, Mamba Target Autoreset Rabbit, Retrieved From Internet, Retrieved on Jun. 27, 2023, <URL: https://www.youtube.com/watch?v=EXajSdMvYcg>.

* cited by examiner

KNOCKDOWN-FIELD-TARGET RESETTING SYSTEM

The current application claims a priority to the U.S. provisional patent application Ser. No. 63/356,012 filed on Jun. 27, 2022.

FIELD OF THE INVENTION

The present invention generally relates to automated reset targets for a gun. More specifically, the present invention relates to systems and methods for automatically resetting gun-targets electronically through a remote-controllable pusher associated with each gun-target box and reset system.

BACKGROUND OF THE INVENTION

Airgun precision shooters train themselves by using targets to practice their skill. Typical types of targets commonly used for this are paper targets or reactive "knockdown" targets that fall when hit. There are also different "classes" of airgun precision shooters requiring different distances, pellet calibers and weights, and also different targets to adjust to the various weights. Examples of the restrictions and rules for various shooting categories are shown below:

- Airgun that is 12-foot pounds and under
  - Field Target shooting, other precision shooting, and World Target Federation competition shooting standard
  - 0.177 or .22 caliber pellets
  - 12 fpe is the limit for EU/UK limit for their Airguns, they can only have 12 fpe or less
- Airgun over 12-foot pounds (up to 20 fpe)
  - Hunting, pest control
  - Some target shooting
  - .22 caliber up to .51 caliber pellets
- Airgun over 20-foot pounds (up to 20 fpe)
  - Hunting, pest control
  - This is where you see larger caliber pellets, and heftier airguns like the "Big Bore", etc.
  - Usually calibers over 0.4
  - Over 20 fpe target can be attached to base
- Gunpowder/Bullets
  - Handguns, shotguns and rifles that use gunpowder bullets/"live rounds"
  - Will require a thicker material target (i.e., steel)—standard is AR500
  - AR500 target can be attached to base
- Airsoft
  - Anything using a plastic "bullet" (really, a plastic BB)/projectile as ammunition
  - Will require a thinner polycarbonate target and more sensitive paddle to knock the target down
  - Airsoft target can be attached to base There are four major components to conventional "reactive" knockdown field targets: a shield, a paddle, base, and a reset cord. The shield is the front plate of the target and is usually in the shape of an animal-crow, squirrel, pig, crow, turkey, ram, or other animal shape.

The paddle is the reactive trigger positioned behind the shield, which causes the whole target (paddle and shield) to fall down. Both the paddle and shield are attached to an (industry standard) target base that allows the shield to be interchangeable with other shapes (or even brands) of target shields of any industry standard reactive knockdown targets.

The reset cord attaches to the front of the shield and allows a user remote from the reactive knockdown field target to reset the target from a long distance from the target so the user does not need to be in danger on a shooting range by walking to reset the target, and so they can reset the target without getting up from their shooting position. In use, a shooter aims for "kill zone" hole in center of target that exposes the paddle. A pellet travels thru kill zone hole in the shield and hits the paddle. As a result-both shield and paddle of target knock down, visually expressing a "hit." Once the target has fallen by hitting the paddle through the kill zone, the shooter must now reset the target to an upright, vertical, shooting position in order to take the next shot. Pulling the string manually pulls the target back to its set position, ready to be shot again. In the example above, the reset cord is formed of 150 ft. of string. Often, conventional use of a string involves the string getting tangled in ground cover between the shooter and the target, the string getting blown away by wind or getting tripped over, and moved, by someone walking across the range when no one is shooting.

The target cannot be lifted by the paddle, it can only be reset by lifting the shield. Hence, the string on the front of the shield is pulled to reset the target, lifting both the shield and the paddle. Conventionally, the only alternative to this (pulling the target up with string) is to walk over to the target and manually reset the target yourself by lifting the shield. Since the shield is attached to the paddle, by lifting/pulling the shield, the whole target will raise-both the shield and the paddle.

The target typically is secured in some fashion before shooting begins. The target stake holes on the edges of the base are used to secure the target base in order to ensure the target does not tip over when shot at (or blow over in windy weather). The target can be staked (or also screwed in) using the stake holes as guides onto any stationary object that is acceptable for target shooting. The targets are usually either secured by being staked directly into the ground or by being screwed into a wooden block. The locations on the base where stake holes appear are in the same locations on all industry standard knockdown field targets. This makes any type of knockdown field target base universal for industry standard knockdown field targets—as the holes used to secure the target to its base are located in the same position for all industry standard field targets.

Another approach that has been taken to avoid the issues associated with resetting traditional knockdown targets is to enable the target with a spring biased to raise the target. An unfortunate result of this type of target, however, is that the targets do not always reset, do not reset with consistent speed, do not always go down or all the way down, and there is no control by the user for resetting the targets. This results in a less satisfying shooting experience.

Yet another approach is the use of weight and gravity to cause the target to automatically reset itself. Similar to the use of springs, this also leaves the user with no control over the reset process, results in inconsistent reset and takes time for gravity to affect the target reset resulting in fast reset sometimes and slow reset other times. Again, a less satisfying shooting experience.

DETAILED DESCRIPTION OF THE INVENTION

Figure 1:
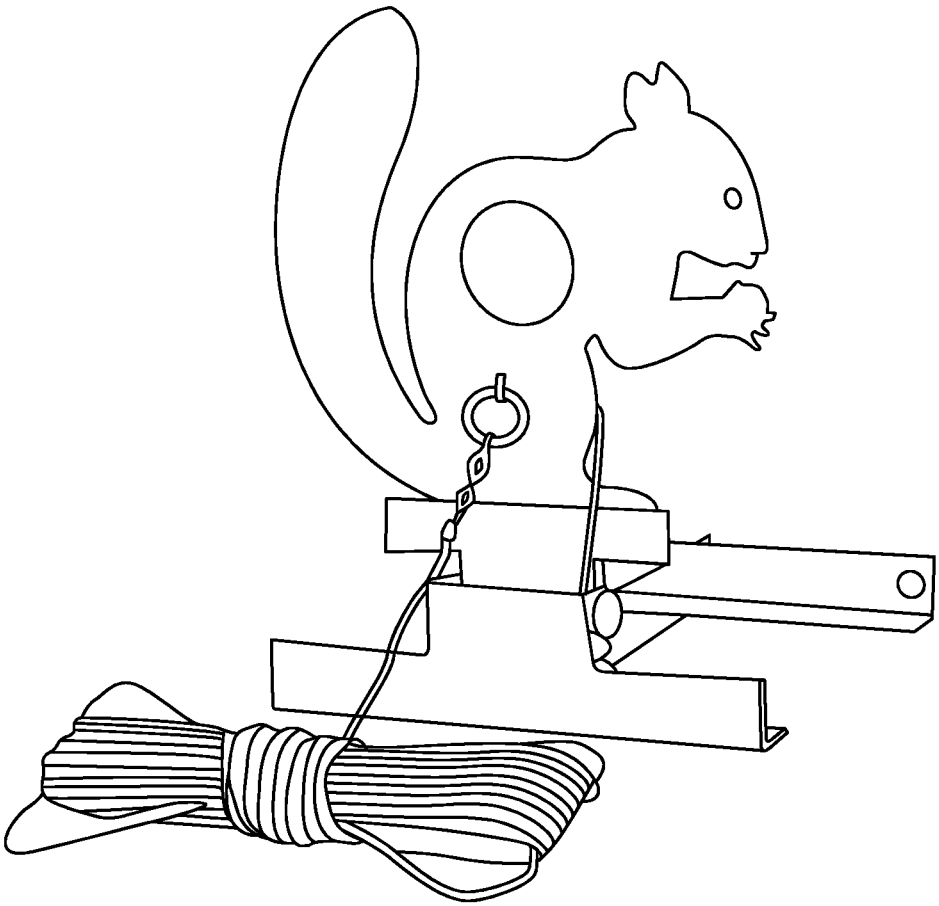
Prior Art FIG. 1
FIG. 1 is an illustration of the prior art for the present invention, wherein the prior art is a knockdown target that is reset with a string.

All illustrations of the drawings are for the purpose of describing selected versions of the present invention and are not intended to limit the scope of the present invention.

The present invention is a knockdown-field-target resetting system that is used to remotely return a knockdown field target to its upright starting position after being shot down from a projectile of a gun. The present invention can reset a knockdown field target that is being shot at by a pneumatically-actuated gun, a chemically-actuated gun, or any other kind of gun. As can be seen in FIGS. 1 through 13, the present invention comprises a device enclosure 1, a microcontroller 5, a wireless communication module 6, a portable power source 7, a lift arm 8, an arm actuator 12, and a remote control 15. The device enclosure 1 is used to house the electronic components of the present invention and is used as an anchor for the rotating movement of the lift arm 8. The microcontroller 5 manages and initiates instructions amongst the electronic components of the present invention. The wireless communication module 6 allows for wireless transfer of information and/or instructions between the microcontroller 5 and the remote control 15. The portable power source 7 is used to electrically power the electronic components of the present invention. The lift arm 8 allows the present invention to physically push a knockdown field target back to its upright starting position. The arm actuator 12 provides the lift arm 8 with the necessary force to physically push a knockdown field target. The remote control 15 allows a user to be located far away from the device enclosure 1 but still allows the user to send information and/or instructions to the lift arm 8. The remote in control 12 is preferably a radio control transmitter but can alternatively be a portable computing device (e.g., a smart-phone, a smart-watch, a laptop, a tablet personal computer, etc.) executing a software application to control the present invention.

In order to describe the aforementioned components in relation to each other, the device enclosure 1 needs to comprise a top base portion 2, a bottom base portion 3, and a lateral portion 4, and the lift arm 8 needs to comprise a proximal arm end 9 and a distal arm end 10. The top base portion 2 and the bottom base portion 3 are relatively flat portions of the device enclosure 1 and are positioned opposite to each other about the device enclosure 1. The lateral portion 4 is positioned in between the top base portion 2 and the bottom base portion 3. Moreover, the proximal arm end 9 and the distal arm end 10 are positioned opposite to each other along the lift arm 8. The proximal arm end 9 is located closer to the device enclosure 1, while the distal arm end 10 is located away from the device enclosure 1.

As can be seen in FIGS. 1 through 13, the general configuration of the aforementioned components allows a user of the present invention to effectively and efficiently reset a knockdown field target from a remote location. The microcontroller 5, the wireless communication module 6, and the portable power source 7 are mounted within the device enclosure 1 so that the device enclosure 1 is able to protect these more fragile components of the prevent invention from external physical damage. The remote control 15 and the lift arm 8 are positioned external to the device enclosure 1 because the remote control 15 needs to be located far away from a knockdown field target and because the lift arm 8 needs to be able to physically push the knockdown field target to its upright starting position. More specifically, the proximal arm end 9 is rotatably connected to the lateral portion 4 about an arm rotation axis 11, which allows the lift arm 8 to swing back and forth without any mechanical interference from the device enclosure 1. The arm actuator 12 is operatively integrated between the lift arm 8 and the device enclosure 1 in order to move the lift arm 8 about the arm rotation axis 11 relative to the device enclosure 1. The remote control 15 is communicatively coupled to the microcontroller 5 through the wireless communication module 6 so that the remote control 15 is able to wirelessly send an instruction to actuate the lift arm 8 and to reset a knockdown field target to its upright starting position. The microcontroller 5 is electronically connected to the wireless communication module 6 and the arm actuator 12, which allows the microcontroller 5 to manage instructions received by the wireless communication module 6 and to relay those instructions to the arm actuator 12. The portable power source 7 is electrically connected to the microcontroller 5, the wireless communication module 6, and the arm actuator 12 so that the portable power source 7 is able to power these electronic components.

The present invention may further comprise a bumper wheel 16, which is used to cushion the physical contact made between a knockdown field target and the lift arm 8. The bumper wheel 16 is rotatably connected to the distal arm end 10 about a wheel rotation axis 17, which allows the bumper wheel 16 to further cushion the physical contact made between a knockdown field target and the lift arm 8 as the bumper wheel 16 rolls against the knockdown field target while pushing up the knockdown field target. The wheel rotation axis 17 is also positioned parallel to the arm rotation axis 11 so that the rotation of the lift arm 8 is synchronized with the rotation of the bumper wheel 16. More specifically, the bumper wheel 16 would be rotatably connected to the distal arm end 10 by a wheel bearing 18, which would allow the bumper wheel 16 to freely spin around the distal arm end 10 and would consequently allow for a smoother motion as the lift arm 8 engages a knockdown field target. The wheel bearing 18 is preferably a ball bearing.

The arm actuator 12 is preferably a servomotor, which is a rotary actuator that allows the microcontroller 5 to precisely adjust the angular position, velocity, and acceleration of the lift arm 8. As can be seen in FIGS. 1 through 13, the servomotor comprises an actuator stator 13 and an actuator rotor 14. The actuator stator 13 is the stationary component of the servomotor, while the actuator rotor 14 is the rotating component of the servomotor. The actuator stator 13 is mounted within the device enclosure 1 in order to anchor the servomotor to the device enclosure 1 as the actuator rotor 14 rotates the lift arm 8. The actuator rotor 14 is torsionally connected to the proximal arm end 9, which allows the servomotor to rotate the lift arm 8 in the desired manner. More specifically, the present invention may further comprise an offsetting disc 19 and an offsetting axle 22 to prevent the device enclosure 1 from mechanically interfering with the rotation of the lift arm 8. The offsetting disc 19 comprises a disc center 20 and a disc periphery 21. The offsetting axle 22 traverses through the lateral portion 4 so that the actuator rotor 14 can be torsionally connected to the disc center 20 by the offsetting axle 22. The proximal arm end 9 is torsionally connected to the disc periphery 21, which allows the lift arm 8 to complete its swinging motion with at least the clearance provided by the offsetting disc 19. Moreover, the arm actuator 12 can alternatively be a linear actuator or a solenoid coil/spring.

As can be seen in FIGS. 6 through 11, the present invention may further comprise a stop protrusion 23, which prevents the lift arm 8 from rotating too far in the wrong direction while moving towards its resting position. The stop protrusion 23 is positioned external to the device enclosure 1 and is connected onto the lateral portion 4, adjacent to the bottom base portion 3, so that the stop protrusion 23 is properly positioned to brace the lift arm 8 in its resting position. The stop protrusion 23 is also positioned offset from the proximal arm end 9 by a distance less than a length of the lift arm 8, which prevents the lift arm 8 from missing the stop protrusion 23 on the way to its resting position.

As can be seen in FIGS. 6 through 9, 11, and 13, the present invention may further comprise at least one charging port 24, which allows the portable power source 7 to be recharged by an external power source. The at least one charging port 24 is integrated through the lateral portion 4 so that the at least one charging port 24 can be electrically connected to the portable power source 7 while being accessible from outside of the device enclosure 1. One embodiment of an external power source is a typical power outlet, which would be used to recharge the portable power source 7 if the device enclosure 1 is taken near a constant source of power (e.g., an electrical outlet located indoors, an electrical outlet for a generator, etc.). However, the present invention may further comprise at least one solar panel 25, which could be used to recharge the portable power source 7 while the device enclosure 1 is outdoors at a remote field location. The at least one solar panel 25 is mounted external to the device enclosure 1 and is electrically connected to the portable power source 7 through the at least one charging port 24, which allows the present invention to readily recharge the portable power source 7.

Figure 12:
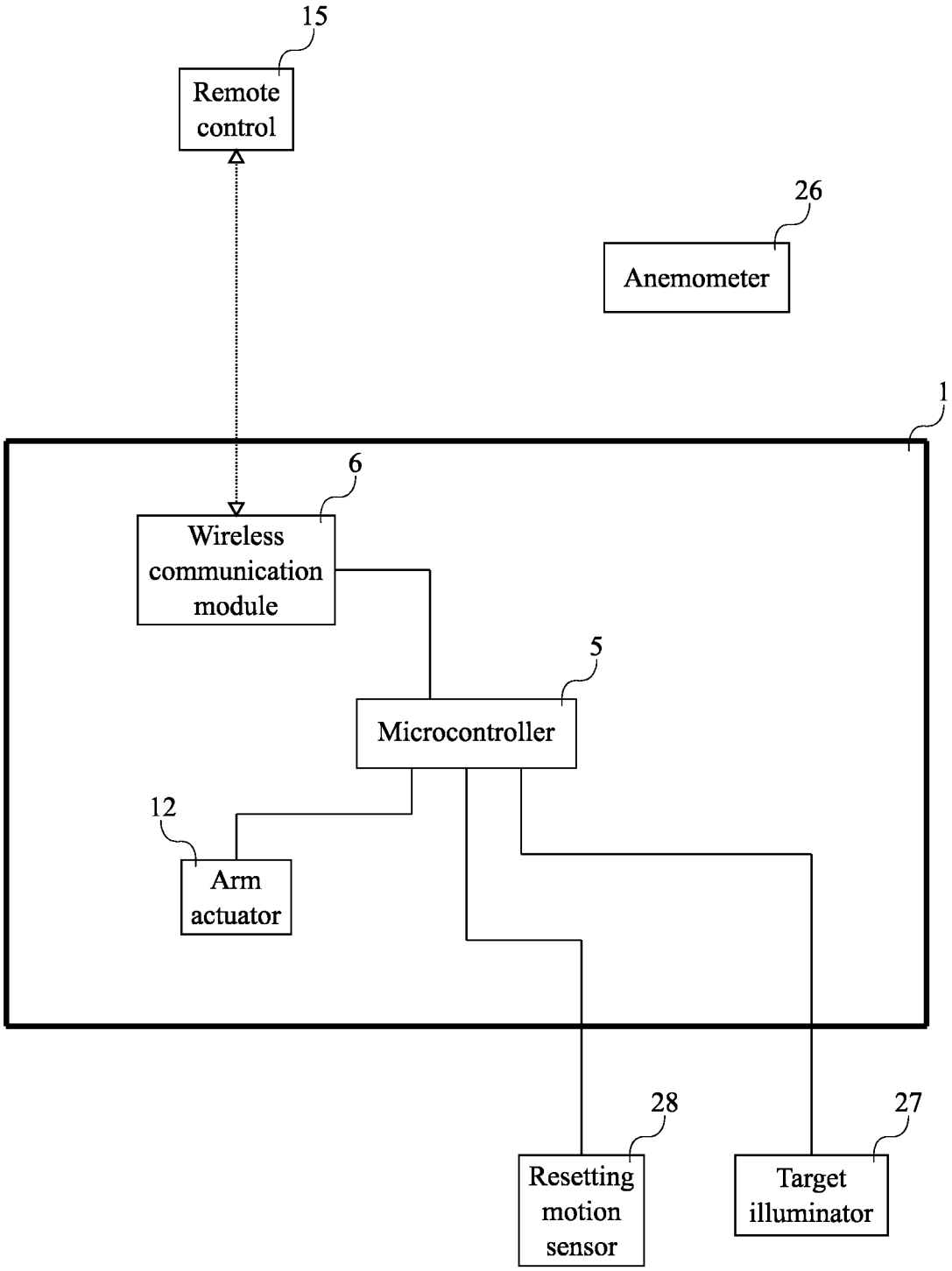
FIG. 12 is a schematic block diagram of the electronic connections between components of the present invention.
Figure 13:
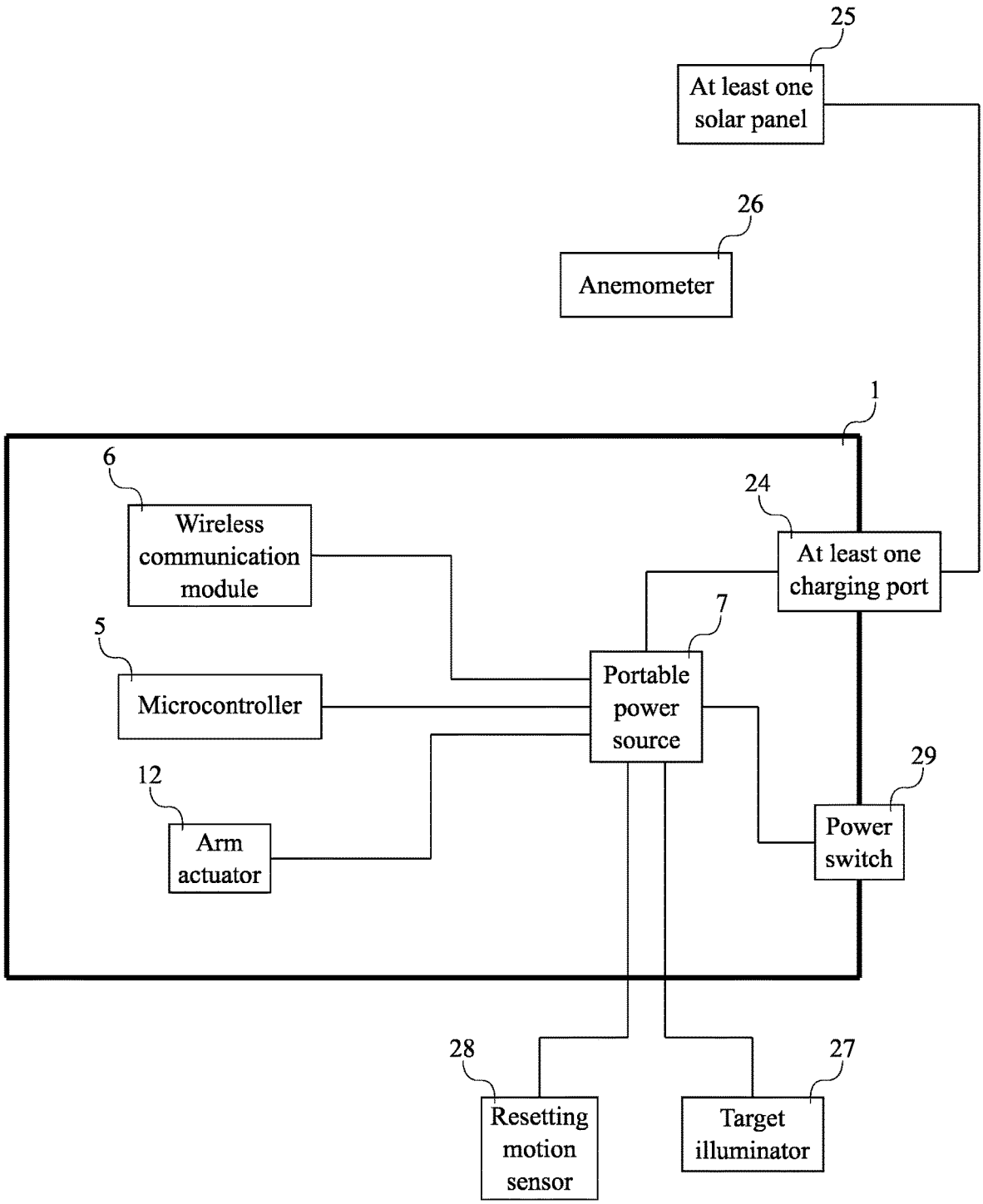
FIG. 13 is a schematic block diagram of the electrical connections between components of the present invention.

As can be seen in FIGS. 12 through 13, the present invention may further comprise an anemometer 26, which allows a user from a remote location to determine the speed and direction of the wind around the device enclosure 1. The anemometer 26 is mounted external to the device enclosure 1 so that the anemometer 26 can be clearly seen by the user. The anemometer 26 is preferably a rod with a string attached at one end of the rod and a mounting mechanism (e.g., a magnet) attached to the other end of the rod.

As can be seen in FIGS. 12 through 13, the present invention may further comprise a target illuminator 27, which allows a user to better see a knockdown field target during evening or nighttime hours. The target illuminator 27 is mounted external to the device enclosure 1 so that the target illuminator 27 can be oriented towards and illuminate a knockdown field target. The target illuminator 27 is electronically connected to the microcontroller 5 so that the target illuminator 27 can be turned on or off based on instructions from the microcontroller 5. The target illuminator 27 is electrically connected to the portable power source 7, which allows the target illuminator 27 to be electrically powered during its use. In some embodiments, the present invention may further comprise a light sensor, which is used to detect when evening and/or nighttime hours are approaching in order to automatically switch on the target illuminator 27.

As can be seen in FIGS. 12 through 13, the present invention may further comprise a resetting motion sensor 28, which is used to detect the falling motion of a knockdown field target. Once the resetting motion sensor 28 detects the falling motion of a knockdown field target, the microcontroller 5 actuates the lift arm 8 in order to automatically raise the knockdown field target back to its upright starting position. The resetting motion sensor 28 is mounted external to the device enclosure 1, adjacent to the top base portion 2, which allows the resetting motion sensor 28 to be properly oriented towards to detect the falling motion of a knockdown field target. The resetting motion sensor 28 is electronically connected to the microcontroller 5 in order to relay a sensor reading to be processed by the microcontroller 5. The resetting motion sensor 28 is electrically connected to the portable power source 7, which allows the resetting motion sensor 28 to be electrically powered during its use.

As can be seen in FIGS. 6 through 9 and 13, the present invention may further comprise a power switch 29, which is used to turn on or off the electronic components of the present invention. The power switch 29 is integrated into the device enclosure 1 so that a user can readily turn on or off the electronic components of the present invention. The power switch 29 is electrically connected to the portable power source 7, which allows the power switch 29 to readily connect or disconnect the electronic components of the present invention to the portable power source 7.

Figure 3:
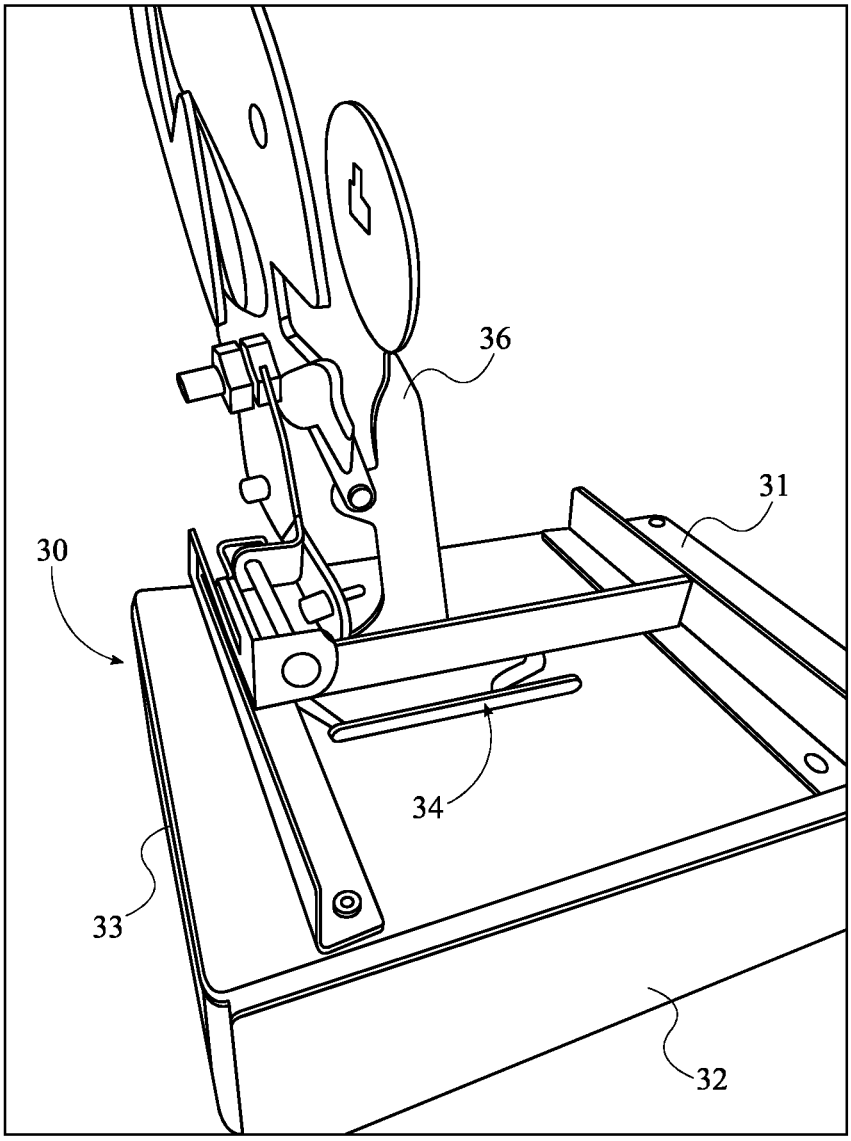
FIG. 3 is an illustration of a knockdown target being mounted onto a target-mounting box for the present invention.
Figure 4:
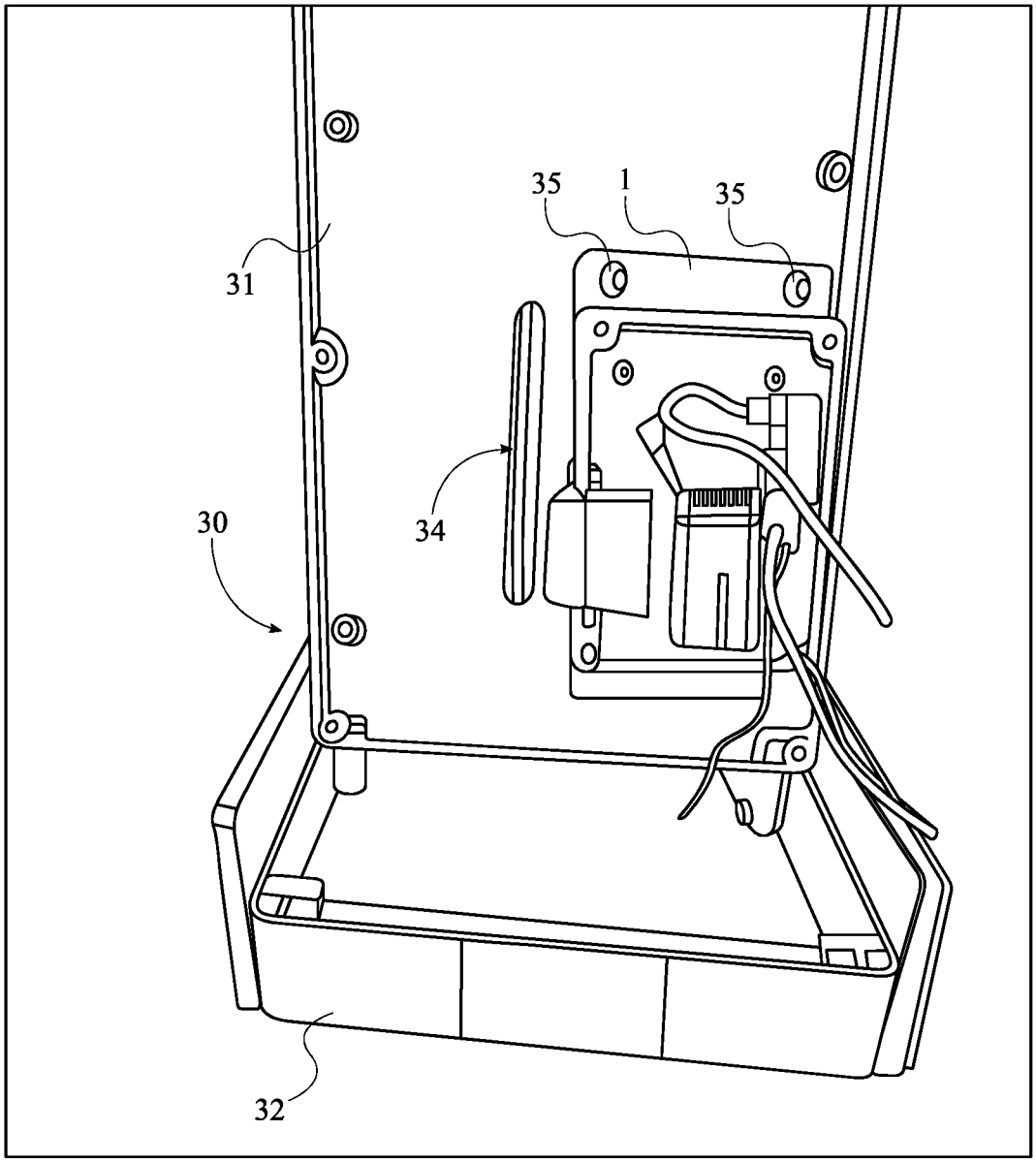
FIG. 4 is an illustration of a device enclosure mounted within a target-mounting box for the present invention.
Figure 5:
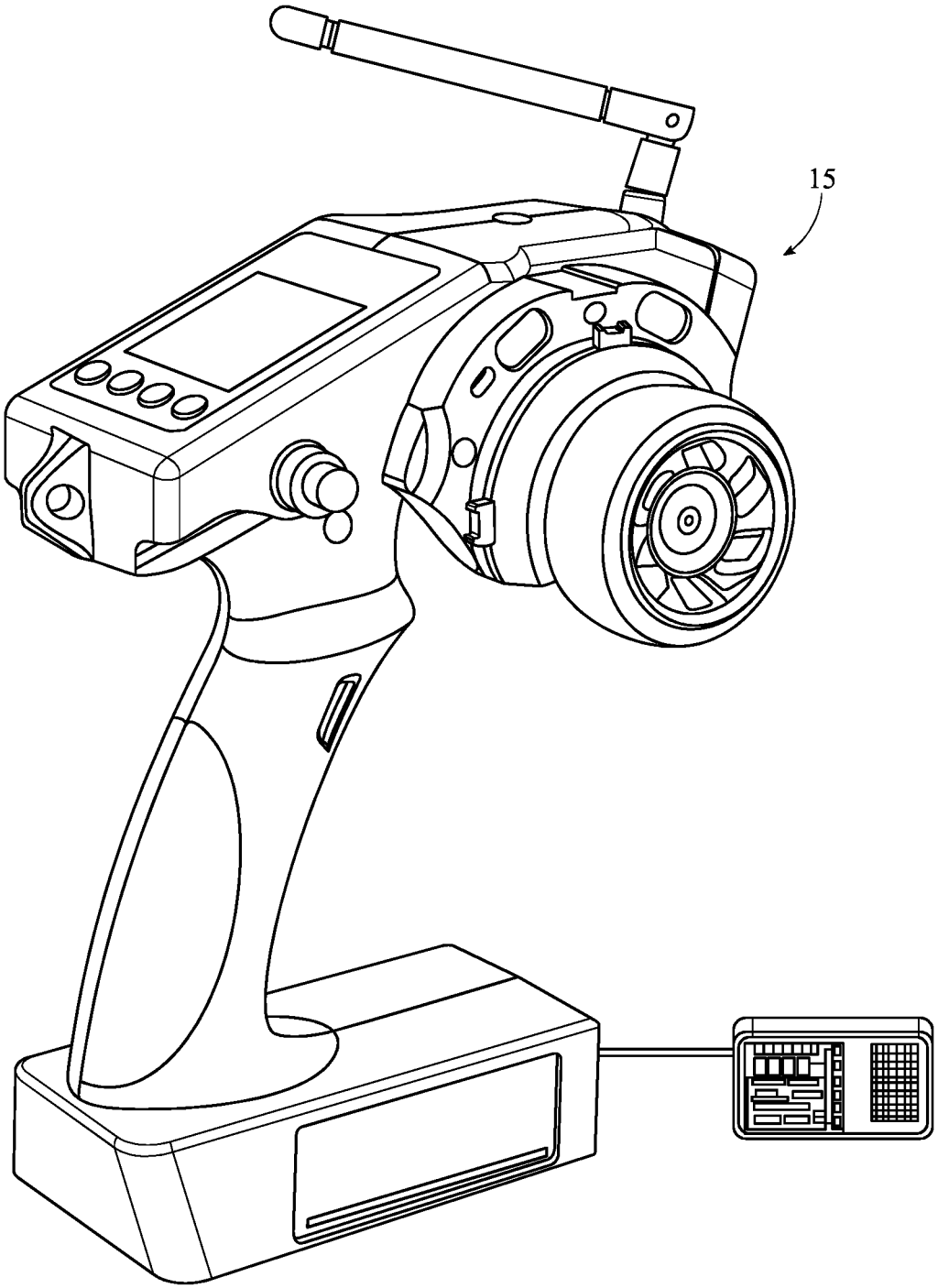
FIG. 5 is an illustration of a remote control for the present invention.
Figure 6:
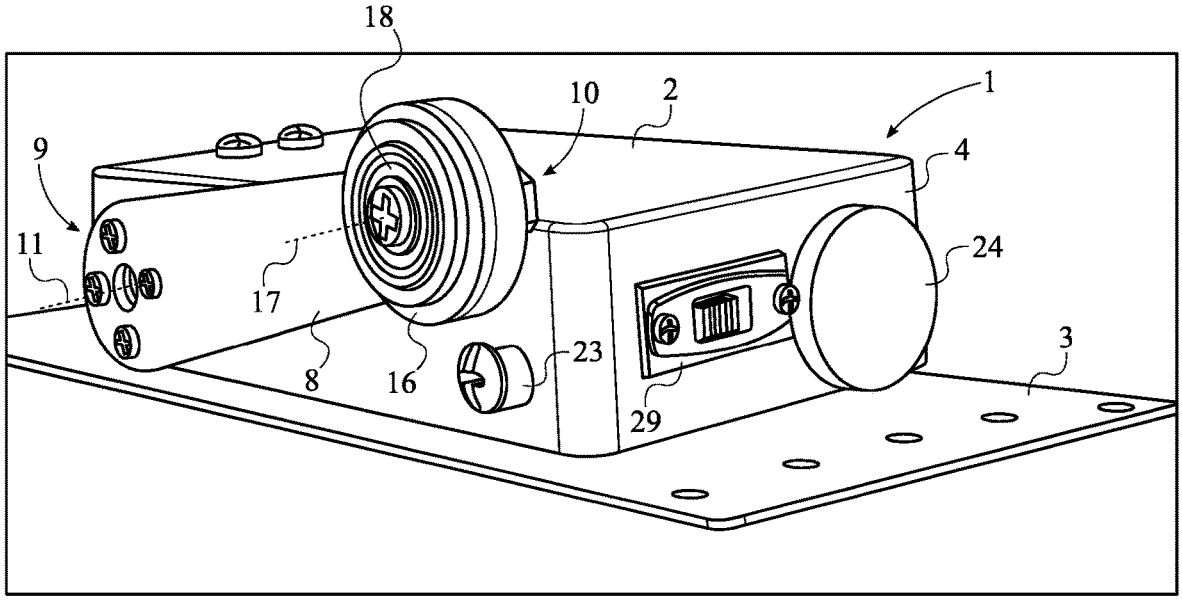
FIG. 6 is an illustration from a perspective view of the present invention.
Figure 7:
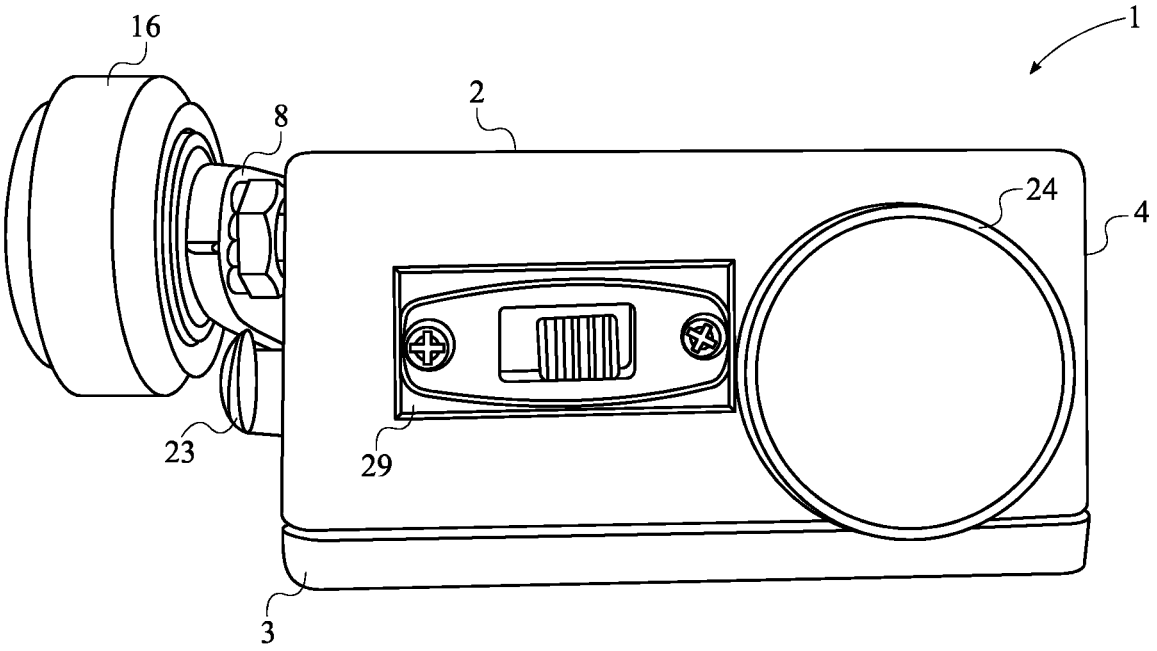
FIG. 7 is an illustration from a perspective view of the present invention with a closed charging port.
Figure 8:
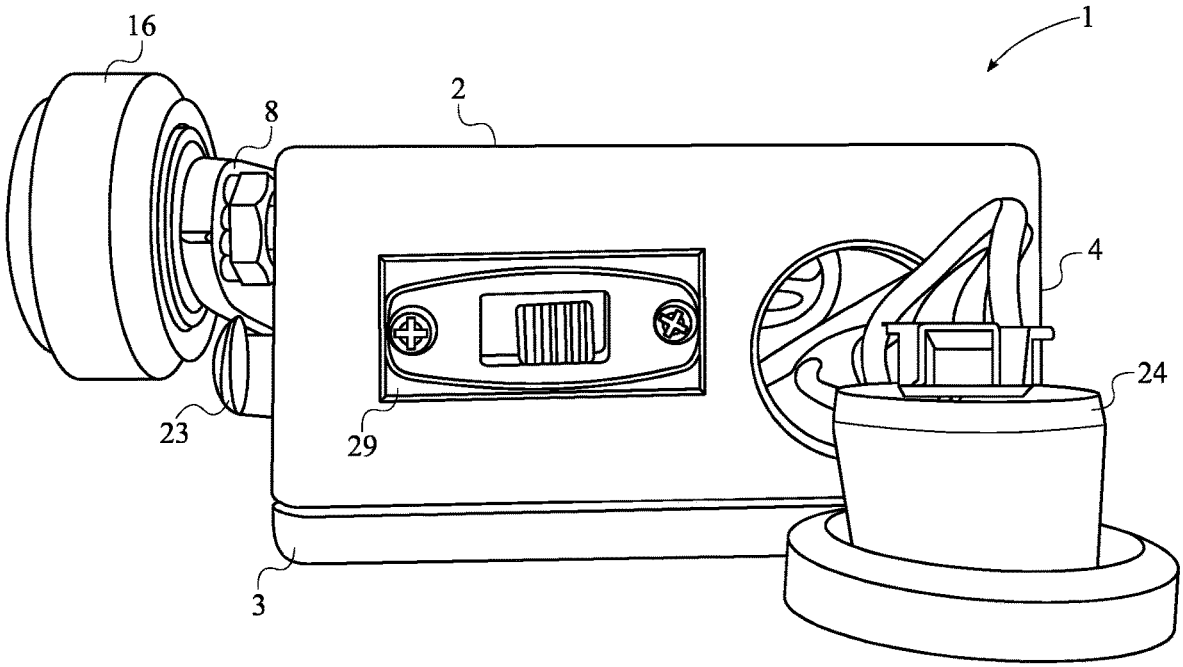
FIG. 8 is an illustration from a front view of the present invention with an open charging port.
Figure 9:
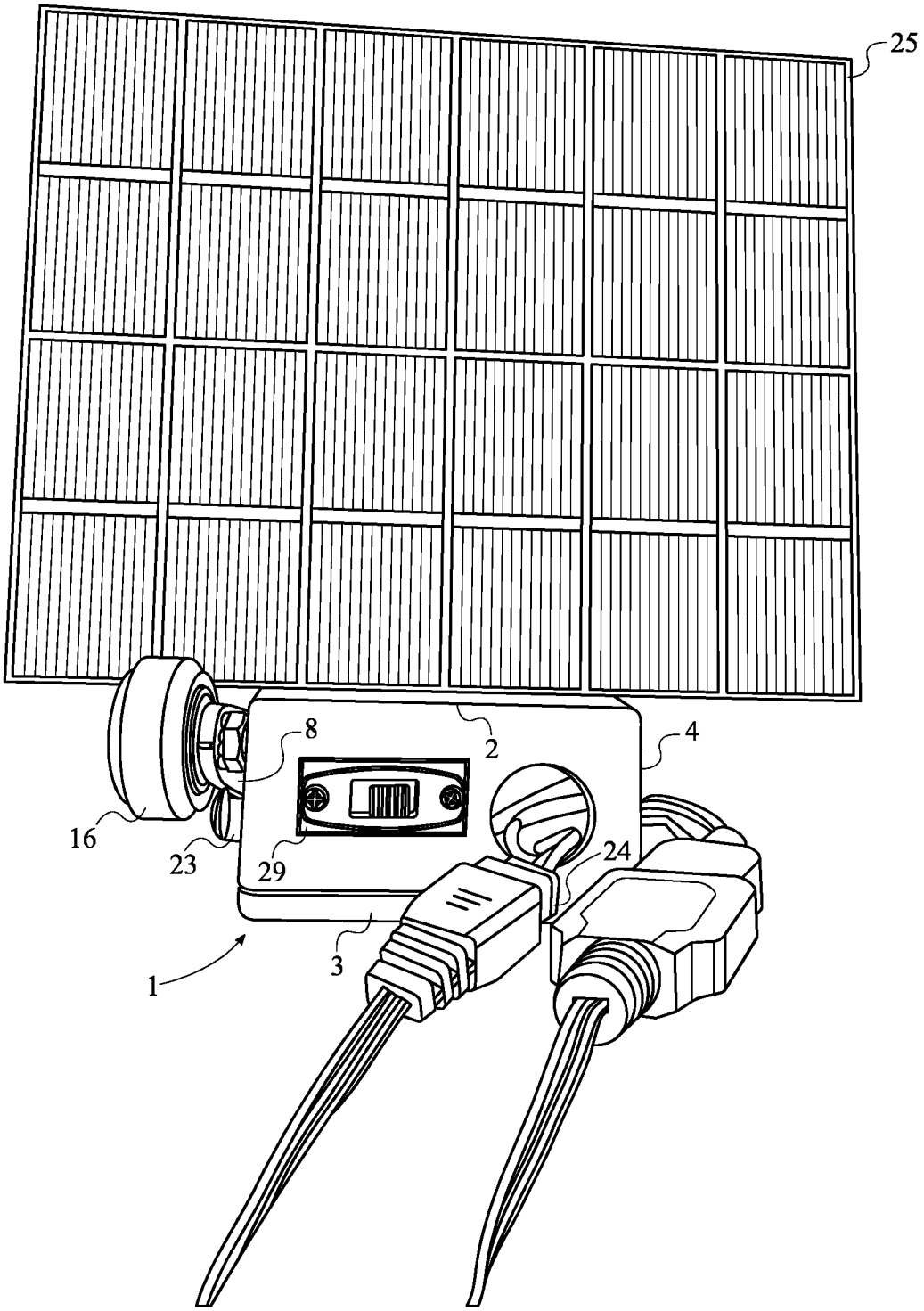
FIG. 9 is an illustration from a front view of the present invention with a solar panel.
Figure 10:
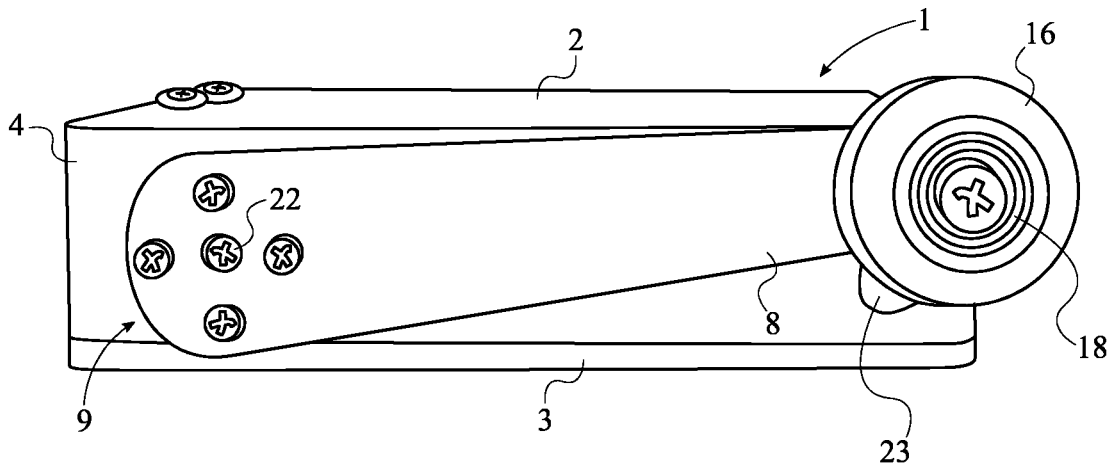
FIG. 10 is an illustration from a side view of the present invention with a solar panel.
Figure 11:
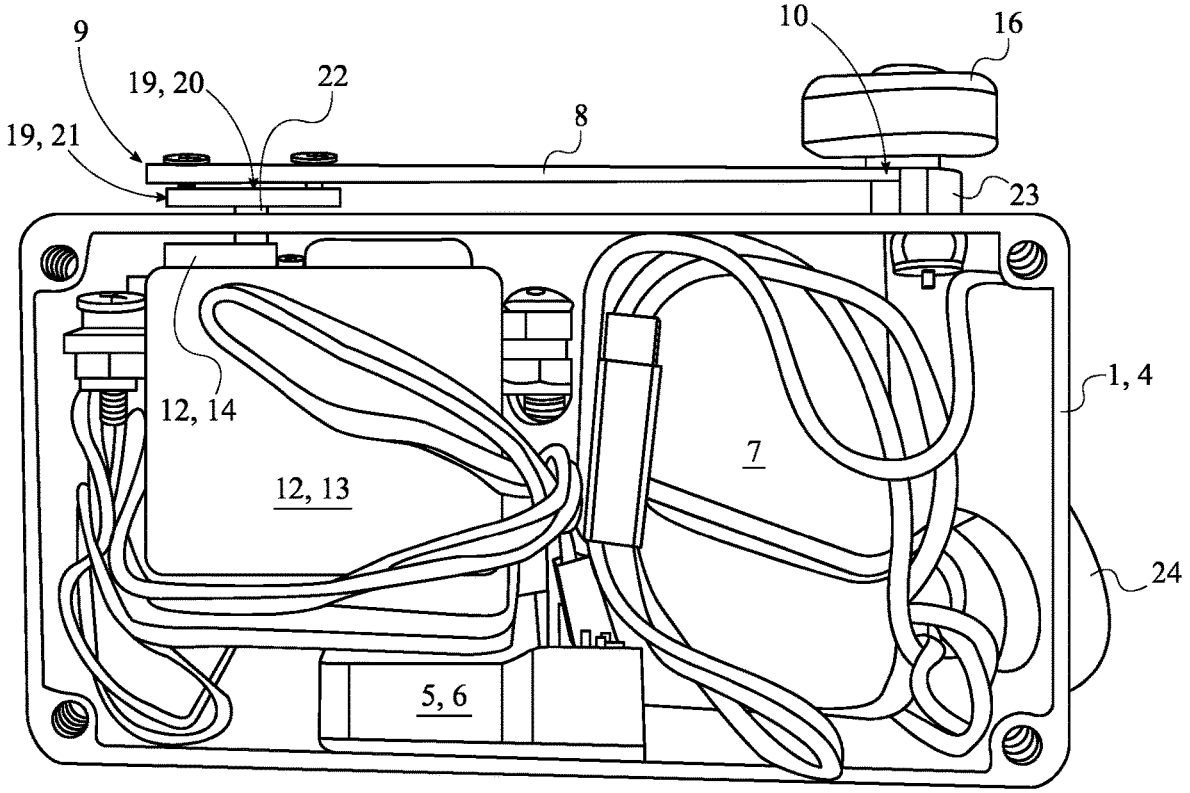
FIG. 11 is an illustration from inside a device enclosure for the present invention.

As can be seen in FIGS. 3 and 4, the present invention may further comprise a target-mounting box 30, which is used to house the device enclosure 1 and may be used to mount a knockdown field target onto its lid. The target-mounting box 30 comprises a box lid 31, a box receptacle 32, a reinforced hinge 33, and an arm-receiving slot 34. The box receptacle 32 is used to retain the contents of the target-mounting box 30, while the box lid 31 is used to close off the contents of target-mounting box 30 and is used as a platform to mount a knockdown field target. The reinforced hinge 33 is a hinge that is durable enough to stay intact despite being hit by a gun projectile. The box lid 31 is rotatably connected to the box receptacle 32 by the reinforced hinge 33 so that the target-mounting box 30 can be readily opened and closed. The arm-receiving slot 34 traverses through the box lid 31 so that the lift arm 8 can rotate in and out of the target-mounting box 30 through the arm-receiving slot 34. The device enclosure 1 is positioned within the target-mounting box 30 and is attached onto the box lid 31 so that the device enclosure 1 and the lift arm 8 are securely situated within the target-mounting box 30. The lift arm 8 is aligned along with the arm-receiving slot 34 in order to prevent any mechanical interference between the box lid 31 and the swinging motion of the lift arm 8. Moreover, the target-mounting box 30 may further comprise a vinyl wrap that is applied across an exterior surface formed by the box lid 31 and the box receptacle 32. The vinyl wrap can be used for a camouflage purpose, a weatherproofing purpose, a decorative purpose, or a combination thereof.

Figure 2:
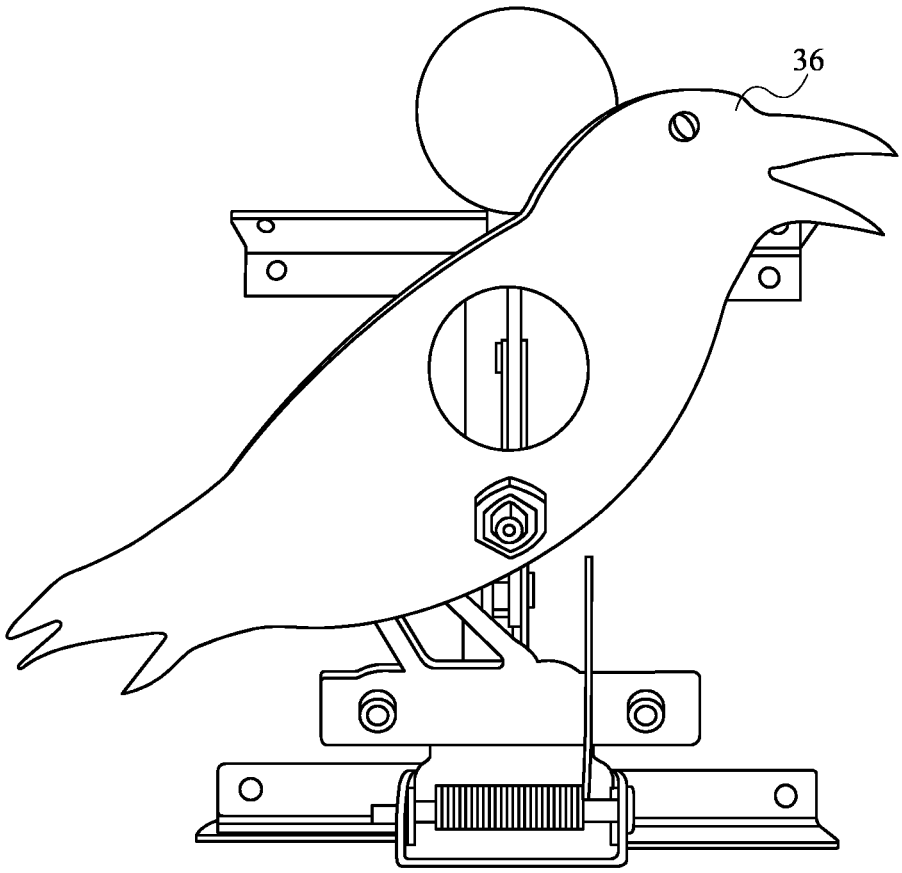
FIG. 2 is an illustration of a knockdown target for the present invention, wherein the knockdown target is reset by the present invention.

As can be seen in FIGS. 2 and 3, the present invention may further comprise an enclosure attachment mechanism 35, which is used to hold the device enclosure 1 in place and is consequently used to orient the lift arm 8 towards a knockdown target 36. The enclosure attachment mechanism 35 is mounted external to the device enclosure 1 in order to attach the device enclosure 1 to another object or setting (e.g., the target-mounting box 30). The enclosure attachment mechanism 35 can be used to attach the device enclosure 1 to a brick, a piece of wood, or any other kind of weighted/fixed object. The enclosure attachment mechanism 35 can be, but is not limited to, a Simpson tie, fasteners, magnets, clamps, etc.

Supplemental Description

A basic principle of operation for the disclosed remote resettable target systems described herein is that instead of pulling the front shield of the target, or manually raising the target shield by hand, present systems automatically, in response to a remote signal, push the shield up to raise both the shield and paddle. Distinct from existing systems requiring a manual pull string, an electronic remote signal signaling the resettable target to reset takes only seconds and reliably resets the target back to the shooting position. As explained more fully below, a remotely activated servo motor pushes the shield, and target, back to a vertical, reset shooting position.

A remote target reset box is physically positioned under the target to be reset and configured to be ready to receive a reset signal from a remote control unit held by the shooter, or another user near the shooter. In particular embodiments, the base of a standard target is able to remain stationary throughout a reset process because the base is physically attached to the remote target reset box or to another box in which the remote target reset box is included, such as through screws extending through the base and into pre-drilled holes in the lid of the box. When the remote control unit is activated to reset the target, it sends the signal through a transmitter within the remote control unit which is received by a receiver within the remote target reset box. This activates a servo motor to begin motion of the reset arm in an upwards direction through a slit opening in the remote target reset box. Although a servo motor is provided as an example of how to activate the reset arm, other components, such as mechanical components, actuators or a solenoid and electromagnetic coil spring, may be used. The reset arm connects with the shield and pushes the weight of the target, pushing both the target and paddle to reset the target to a shooting position. Although the system described herein includes many components, it should be clear to those reading the disclosure that the remote target reset box may be manufactured and sold separate from a target so that customers can use their own existing targets and even remote controllers.

When conventional steel airgun knockdown targets are used, like the type described in the Background and Context section, in combination with a remote target reset box, all of the benefits of the conventional knockdown targets are still available but now with the advantages of an automatic remote target reset system. For example, some conventional steel airgun knockdown targets include an H-shaped base, making it possible to quickly change out targets and use multiple different targets at different times on the same remote target reset box by simply removing the attachments and replacing the target with another one. In particular embodiments, quick-connect clips may be used to attach the target base to the remote target reset box for quick, but secure, attachment and detachment of a target.

Altogether, the remote target reset system includes a target with a shield, a paddle, kill zone hole and base, the target being interchangeable. The target base is affixed to an upper surface of a main housing box. Within the box, a remote target reset box is positioned against, and in some embodiments coupled to, a lower surface opposite the upper surface of the main housing box with the reset arm (servo arm) moveably coupled to servo motor, such as the Feetech 35 KG Servo Motor, associated with the remote target reset box to extend the reset arm through the upper surface to push the shield of the target back to the shooting position. A servo horn couples the reset arm (servo arm) to the servo motor.

The reset arm itself is, in a particular embodiment, approximately four (4) inches long, one (1) inch wide, and ⅛" thick. Although other particular dimensions for the reset arm are acceptable and even contemplated, this size works particularly well for the standard GAMO-type targets discussed earlier, when used with the main box and remote target reset box described herein. The reset arm includes rounded ends on a polycarbonate arm, and in particular embodiments, the tip is configured to receive a ball bearing. The ball bearing on the tip of the reset arm allows the reset arm to slide more gently against the shield as it pushes it up into the shooting position. An example of a ball bearing, such as that by Honoson, though other manufacturers and ball bearing types are contemplated and acceptable.

In particular embodiments, the main box may be formed of, or wrapped in, polycarbonate to resist damage from the projectiles of an airgun shooting at the target. ⅛" or ¼" polycarbonate sheets were used to wrap the main box. In other embodiments, a metal box may be used and can even be custom wrapped with vinyl for looks.

In a particular embodiment, a metal box, such as a medical box, is used for the main box and a hinge protector that includes a magnet and metal plate are removably attached to the main box over the hinge to protect the hinge from being damaged during shooting. Stake holes may be included on the main box for attaching the main box to the ground during use.

There are many remote controls that would work for this type of system. One example that is smart enough to distinguish frequencies and signals so that resetting one remote target reset or set of remote target resets would not necessarily reset all of the remote targets resets in the area. This non-limiting example is the Radiolink RC4GS V2 4 Channel RC Transmitter and R6FG Gyro Receiver 2.4 GHz Surface Remote Controller by Radiolink. Although this particular remote controller is more complicated and has greater frequency distinctions available, even a simple remote controller with a simple temporary switch for resetting may be used.

Inside the remote target reset box, the necessary components as discussed above may be included. In particular, a rechargeable battery is useful and allows the remote resettable target system to be charged and placed in a distant location at an end of a shooting range without the need to also run an extension cord the distance that can be up to 150 feet or more.

As should be clear to one of ordinary skill in the art from this disclosure, the remote resettable target system may include a single target remote reset box or may include a plurality of target remote reset boxes that can be reset with a single remote controller. For example, in a target competition, or for pleasure or practice target shooting, multiple targets may be set up together. For example, two targets per lane, with approximately 10 lanes or more may be set up for a target competition. Because the remote target reset box or the main box may be configured to include attachment points pre-formed on the box to receive a standard knockdown target, it can be used universally for multiple different knockdown targets and even multiple knockdown target styles.

In particular embodiments, an anemometer may be attached to the main box to assist in gauging the wind direction. For example, a rod with a string attached at an upper end may be attached to a back side of the main base behind the target to serve as an anemometer. The rod may be configured with a strong magnet on its lower end to attach anywhere on the main box if the main box is metal, or configured to attach to a specific location with a corresponding magnet if that is how the box is configured to adapt to the anemometer rod connection.

In particular embodiments, the remote reset box may be configured with a solar panel to charge the batteries associated with the box. Particularly in such embodiments, a panel of LED lights may be included on or in the box and directed to illuminate a target mounted on the main box for night shooting. A day/night/ambient light sensor may also be included with appropriate circuitry to automatically switch on the LED lights when it begins to get dark around the target. By including the illumination source within the target system and protected by the main box, the targets mounted to the remote reset box becomes useable at night. Conventionally, shooters have used a flashlight positioned near the target, but the flashlight risks damage from shooters and must be propped up to shine in the right direction. It is much easier to include the light source within the main box holding the target, powered by the remote reset box.

Whether an LED light source is included within the system or not, solar panels may be used to charge the battery for the remote target reset box to power its components. In one particular embodiment, the solar panel may be built into a surface of the main box, such as on a bottom side of the box, opposite where the target mounts. In this way, the solar panels are protected when the target is being shot. A user merely needs to turn the main box upside down or tilt it toward the sun to charge the batteries.

Although the embodiments herein have been described with respect to airgun targets, it is specifically contemplated that the same principles may be applied to other types of targets used for other types of target practice. For example, and without limitation, airsoft, rimfire, gunpowder and other firearms targets may be used. Specific components used and specific dimensions and parts may change, but the general concept may be applied to all types of targets by one of ordinary skill in the art.

It will be understood that implementations of a remote resettable target system include but are not limited to the specific components disclosed herein, as virtually any components consistent with the intended operation of various remote resettable target systems may be utilized. Accordingly, for example, it should be understood that, while the drawings, and photos, and accompanying text show and describe particular remote resettable target system implementations, any such implementation may comprise any shape, size, style, type, model, version, class, grade, measurement, concentration, material, weight, quantity, and/or the like consistent with the intended operation of a remote resettable target system.

The concepts disclosed herein are not limited to the specific remote resettable target systems shown and described herein. For example, it is specifically contemplated that the components included in particular remote resettable target systems may be formed of any of many different types of materials or combinations that can readily be formed into shaped objects and that are consistent with the intended operation of a remote resettable target system. For example, the components may be formed of: rubbers (synthetic and/or natural) and/or other like materials; glasses (such as fiberglass), carbon-fiber, aramid-fiber, any combination therefore, and/or other like materials; elastomers and/or other like materials; polymers such as thermoplastics (such as ABS, fluoropolymers, polyacetal, polyamide, polycarbonate, polyethylene, polysulfone, and/or the like, thermosets (such as epoxy, phenolic resin, polyimide, polyurethane, and/or the like), and/or other like materials; plastics and/or other like materials; and/or any combination of the foregoing.

Furthermore, remote resettable target systems may be manufactured separately and then assembled together, or any or all of the components may be manufactured simultaneously and integrally joined with one another. Manufacture of these components separately or simultaneously, as understood by those of ordinary skill in the art, may involve 3-D printing, extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular remote resettable target system implementations, it should be readily apparent that a number of modifications may be made without departing from the spirit thereof and that these implementations may be applied to other implementations disclosed or undisclosed. The presently disclosed remote resettable target systems are, therefore, to be considered in all respects as illustrative and not restrictive.

Although the invention has been explained in relation to its preferred embodiment, it is to be understood that many other possible modifications and variations can be made without departing from the spirit and scope of the invention as hereinafter claimed.

What is claimed is:

1. A knockdown-field-target resetting system comprising:

a device enclosure;

a microcontroller;

a wireless communication module;

a portable power source;

a lift arm;

an arm actuator;

a remote control;

an offsetting disc;

an offsetting axle;

the device enclosure comprising a top base portion, a bottom base portion, and a lateral portion;

the lift arm comprising a proximal arm end and a distal arm end;

the lateral portion being a closed-loop wall with a top edge and a bottom edge;

the top edge and the bottom edge being positioned opposite to each other about the closed-loop wall;

the top edge being perimetrically connected around the top base portion;

the bottom edge being perimetrically connected around the bottom base portion;

the closed-loop wall being perpendicularly positioned in between the top base portion and the bottom base portion;

the microcontroller, the wireless communication module, and the portable power source being mounted within the device enclosure;

the remote control and the lift arm being positioned external to the device enclosure;

the proximal arm end being rotatably connected to the lateral portion about an arm rotation axis;

the arm actuator being operatively integrated between the lift arm and the device enclosure, wherein the arm actuator is used to move the lift arm about the arm rotation axis relative to the device enclosure;

the microcontroller being electronically connected to the wireless communication module and the arm actuator;

the portable power source being electrically connected to the microcontroller, the wireless communication module, and the arm actuator;

the remote control being communicatively coupled to the microcontroller through the wireless communication module;

the arm actuator being a servomotor;

the servomotor comprising an actuator stator and an actuator rotor;

the actuator stator being mounted within the device enclosure;

the actuator rotor being torsionally connected to the proximal arm end;

the offsetting disc comprising a disc center and a disc periphery;

the offsetting axle traversing through the lateral portion;

the actuator rotor being torsionally connected to the disc center by the offsetting axle; and the proximal arm end being torsionally connected to the disc periphery.

2. The knockdown-field-target resetting system as claimed in claim 1 comprising:

a bumper wheel;

the bumper wheel being rotatably connected to the distal arm end about a wheel rotation axis; and the wheel rotation axis being positioned parallel to the arm rotation axis.

3. The knockdown-field-target resetting system as claimed in claim 2 comprising:

a wheel bearing; and the bumper wheel being rotatably connected to the distal arm end by the wheel bearing.

4. The knockdown-field-target resetting system as claimed in claim 1 comprising:

a stop protrusion;

the stop protrusion being positioned external to the device enclosure;

the stop protrusion being positioned offset from the proximal arm end by a distance less than a length of the lift arm; and the stop protrusion being connected onto the lateral portion, adjacent to the bottom base portion.

5. The knockdown-field-target resetting system as claimed in claim 1 comprising:

at least one charging port;

the at least one charging port being integrated through the lateral portion; and the at least one charging port being electrically connected to the portable power source.

6. The knockdown-field-target resetting system as claimed in claim 5 comprising:

at least one solar panel;

the at least one solar panel being mounted external to the device enclosure; and the at least one solar panel being electrically connected to the portable power source through the at least one charging port.

7. The knockdown-field-target resetting system as claimed in claim 1 comprising:

an analog anemometer; and the analog anemometer being mounted external to the device enclosure.

8. The knockdown-field-target resetting system as claimed in claim 1 comprising:

a target illuminator;

the target illuminator being mounted external to the device enclosure;

the target illuminator being electronically connected to the microcontroller; and the target illuminator being electrically connected to the portable power source.

9. The knockdown-field-target resetting system as claimed in claim 1 comprising:

a resetting motion sensor;

the resetting motion sensor being mounted external to the device enclosure, adjacent to the top base portion;

the resetting motion sensor being electronically connected to the microcontroller; and the resetting motion sensor being electrically connected to the portable power source.

10. The knockdown-field-target resetting system as claimed in claim 1 comprising:

a power switch;

the power switch being integrated into the device enclosure; and the power switch being electrically connected to the portable power source.

11. The knockdown-field-target resetting system as claimed in claim 1 comprising:

a target-mounting box;

the target-mounting box comprising a box lid, a box receptacle, a reinforced hinge, and an arm-receiving slot;

the box lid being rotatably connected to the box receptacle by the reinforced hinge;

the arm-receiving slot traversing through the box lid;

the device enclosure being positioned within the target-mounting box;

the device enclosure being attached onto the box lid; and the lift arm being aligned along with the arm-receiving slot.

12. The knockdown-field-target resetting system as claimed in claim 1 comprising:

an enclosure attachment mechanism; and the enclosure attachment mechanism being mounted external to the device enclosure.

13. A knockdown-field-target resetting system comprising:

a device enclosure;

a microcontroller;

a wireless communication module;

a portable power source;

a lift arm;
an arm actuator;
a remote control;
an offsetting disc;
an offsetting axle;
a stop protrusion;
a bumper wheel;
a wheel bearing;
an analog anemometer;
the device enclosure comprising a top base portion, a bottom base portion, and a lateral portion;
the lift arm comprising a proximal arm end and a distal arm end;
the lateral portion being a closed-loop wall with a top edge and a bottom edge;
the top edge and the bottom edge being positioned opposite to each other about the closed-loop wall;
the top edge being perimetrically connected around the top base portion;
the bottom edge being perimetrically connected around the bottom base portion;
the closed-loop wall being perpendicularly positioned in between the top base portion and the bottom base portion;
the microcontroller, the wireless communication module, and the portable power source being mounted within the device enclosure;
the remote control and the lift arm being positioned external to the device enclosure;
the proximal arm end being rotatably connected to the lateral portion about an arm rotation axis;
the arm actuator being operatively integrated between the lift arm and the device enclosure, wherein the arm actuator is used to move the lift arm about the arm rotation axis relative to the device enclosure;
the microcontroller being electronically connected to the wireless communication module and the arm actuator;
the portable power source being electrically connected to the microcontroller, the wireless communication module, and the arm actuator;
the remote control being communicatively coupled to the microcontroller through the wireless communication module;
the bumper wheel being rotatably connected to the distal arm end about a wheel rotation axis by the wheel bearing;
the wheel rotation axis being positioned parallel to the arm rotation axis;
the analog anemometer being mounted external to the device enclosure;
the arm actuator being a servomotor;
the servomotor comprising an actuator stator and an actuator rotor;
the offsetting disc comprising a disc center and a disc periphery;
the actuator stator being mounted within the device enclosure;
the actuator rotor being torsionally connected to the proximal arm end;
the offsetting axle traversing through the lateral portion;
the actuator rotor being torsionally connected to the disc center by the offsetting axle;
the proximal arm end being torsionally connected to the disc periphery;
the stop protrusion being positioned external to the device enclosure;
the stop protrusion being positioned offset from the proximal arm end by a distance less than a length of the lift arm; and
the stop protrusion being connected onto the lateral portion, adjacent to the bottom base portion.

14. The knockdown-field-target resetting system as claimed in claim 13 comprising:
at least one charging port;
at least one solar panel;
a power switch;
the at least one charging port being integrated through the lateral portion;
the at least one charging port being electrically connected to the portable power source;
the at least one solar panel being mounted external to the device enclosure;
the at least one solar panel being electrically connected to the portable power source through the at least one charging port;
the power switch being integrated into the device enclosure; and
the power switch being electrically connected to the portable power source.

15. The knockdown-field-target resetting system as claimed in claim 13 comprising:
a target illuminator;
the target illuminator being mounted external to the device enclosure;
the target illuminator being electronically connected to the microcontroller; and
the target illuminator being electrically connected to the portable power source.

16. The knockdown-field-target resetting system as claimed in claim 13 comprising:
a resetting motion sensor;
the resetting motion sensor being mounted external to the device enclosure, adjacent to the top base portion;
the resetting motion sensor being electronically connected to the microcontroller; and
the resetting motion sensor being electrically connected to the portable power source.

17. The knockdown-field-target resetting system as claimed in claim 13 comprising:
a target-mounting box;
an enclosure attachment mechanism;
the target-mounting box comprising a box lid, a box receptacle, a reinforced hinge, and an arm-receiving slot;
the box lid being rotatably connected to the box receptacle by the reinforced hinge;
the arm-receiving slot traversing through the box lid;
the device enclosure being positioned within the target-mounting box;
the device enclosure being attached onto the box lid by the enclosure attachment mechanism; and
the lift arm being aligned along with the arm-receiving slot.

* * * * *